US010961026B2

(12) United States Patent
Bevan et al.

(10) Patent No.: US 10,961,026 B2
(45) Date of Patent: Mar. 30, 2021

(54) CLOSURE

(71) Applicant: CREANOVA UNIVERSAL CLOSURES LTD., Tewkesbury (GB)

(72) Inventors: David Bevan, Herefordshire (GB); James Dimond, Tewkesbury (GB)

(73) Assignee: CREANOVA UNIVERSAL CLOSURES LTD., Tewkesbury (GB)

( * ) Notice: Subject to any disclaimer, the term of this patent is extended or adjusted under 35 U.S.C. 154(b) by 0 days.

(21) Appl. No.: 16/327,166

(22) PCT Filed: Sep. 8, 2017

(86) PCT No.: PCT/EP2017/072577
§ 371 (c)(1),
(2) Date: Feb. 21, 2019

(87) PCT Pub. No.: WO2018/059909
PCT Pub. Date: Apr. 5, 2018

(65) Prior Publication Data

US 2019/0210774 A1 Jul. 11, 2019

(30) Foreign Application Priority Data

Sep. 29, 2016 (CH) ..... 1290/16

(51) Int. Cl.
*B65D 47/08* (2006.01)
*B65D 81/26* (2006.01)
(Continued)

(52) U.S. Cl.
CPC ..... *B65D 47/0809* (2013.01); *B65D 41/48* (2013.01); *B65D 47/243* (2013.01);
(Continued)

(58) Field of Classification Search
CPC ..... B65D 47/0809; B65D 47/243; B65D 47/263; B65D 81/261; B65D 41/48;
(Continued)

(56) References Cited

U.S. PATENT DOCUMENTS 5,975,369 A * 11/1999 Yurkewicz ..... B65D 41/32 222/153.06
6,050,452 A 4/2000 Pradinas
(Continued)

FOREIGN PATENT DOCUMENTS

WO 2002/016220 A1 2/2002

OTHER PUBLICATIONS

International Search Report and Written Opinion received for PCT Patent Application No. PCT/EP2017/072577 dated Nov. 10, 2017, 11 page.

*Primary Examiner* — James N Smalley
(74) *Attorney, Agent, or Firm* — Amster, Rothstein & Ebenstein LLP

(57) ABSTRACT

A closure comprising a base body with a circumferential recess foreseen to receive a tamper band connected to a top cover. The circumferential recess comprises at least one circumferential protrusion extending in a radial direction into the recess which comprises at least one pillar extending in the radial direction into the recess, tamper band comprises at least one circumferential undercut foreseen to interact in a mounted position with the circumferential protrusion of the circumferential recess. The tamper band comprises at least one notch foreseen to receive at least one pillar arranged in the circumferential recess.

15 Claims, 5 Drawing Sheets

(51) Int. Cl.

| | |
|---|---|
| ***B65D 41/48*** | (2006.01) |
| ***B65D 51/18*** | (2006.01) |
| ***B65D 85/72*** | (2006.01) |
| ***B65D 47/24*** | (2006.01) |
| ***B65D 47/26*** | (2006.01) |

(52) U.S. Cl.
CPC ..... *B65D 47/263* (2013.01); *B65D 51/18* (2013.01); *B65D 81/261* (2013.01); *B65D 85/72* (2013.01); *B65D 2251/0015* (2013.01); *B65D 2251/0087* (2013.01); *B65D 2401/30* (2020.05)

(58) Field of Classification Search
CPC .... B65D 51/18; B65D 85/72; B65D 2401/30; B65D 2251/0015; B65D 2251/0087
USPC ..... 222/556
See application file for complete search history.

(56) References Cited

U.S. PATENT DOCUMENTS

| | | | | |
|---|---|---|---|---|
| 6,338,425 | B1 * | 1/2002 | Berge | B65D 47/242 222/521 |
| 2013/0119061 | A1 * | 5/2013 | Smith | B65D 47/0809 220/265 |
| 2015/0175318 | A1 * | 6/2015 | Pellerin | B65D 47/0861 215/230 |

* cited by examiner

CLOSURE

This application is a National Stage entry under 35 U.S.C. 371 of International Patent Application No. PCT/EP2017/072577, filed on Sep. 8, 2017, which claims priority to Swiss Patent Application No. CH 1290/16, filed Sep. 29, 2016, the entire contents of each of which are incorporated by reference herein.

FIELD OF THE INVENTION

The invention relates to a closure, especially a closure for packages for liquids such as beverages. In particular the invention relates to a closure for containers for carbonated liquids such as soft drinks, but is well adapted to seal other containers such as glass or PET containers with contents at above or below atmospheric pressure or having gaseous components or requiring a hermetic seal.

BACKGROUND OF THE INVENTION

Generally, beverages or packages for liquids are closed by means such as screw caps which can be removed and allow a closure after usage such as pouring the liquid out of the liquid container. The crew cap seals the container if attached and further prevents a contamination of the liquid. The outlet usually is circular with respective larger diameter and permits a high flow rate. The outlet is primarily designed in order to pour the liquid and not to drink directly from the beverages.

In certain application, such as beverages for sport drinks, however, the drinking directly from the beverage respective the liquid container is desired. Therefore, other geometries of closures are preferred. Such closures may include a part which the user can place directly inside the month. Furthermore, a valve may ensure a lower flow rate for comfortable drinking. Often, the valve may further seal the liquid container. In the following examples are given for such closure designs.

WO10046567, published on the 29 Apr. 2010 by Bericap, relates to a stopper for affixing to the neck of a container of liquids, comprising: a main body provided internally with a means of connection to said neck and surmounted by a tubular projection having an outer wall defining a reference axis; a cap covering said tubular projection and provided internally with elastic pillars which engage with a groove in the tubular projection; a tamper-resistant ring continuing on in the distal direction from said cap, to which it is connected by evenly spaced frangible bridges separated from one another by incisions. According to the invention, said ring is provided with teeth shaped to engage with evenly spaced mating protuberances on a proximal end of the main body, the teeth and/or protuberances having a chamfered prismatic profile.

US2005011911, published on the 20 Jan. 2005 by Britvic Soft Drinks LTD, discloses a closure for a beverage container, which may have a base cap for securing to the container and a detachable over-cap for protecting a valve member providing an outlet through which a beverage can be dispensed. The over-cap has an array of holes providing airways through the over-cap to prevent choking if the over-cap is accidentally swallowed and lodges in the throat in any orientation. The holes are arranged to permit through flow of air in any orientation of the over-cap. The over-cap may also be provided with ribs or channels providing airways to allow flow of air around the outside of the cap if swallowed and lodging in the throat. WO0216220, published on the 28 Feb. 2002 by Rical SA, concerns a closure comprising a base part having an outer annular projection and peripheral notches and a part forming a cap designed to be mounted on the base part, comprising a tamperproof strip having an inner annular projection and peripheral notches. The co-operation between the projections and the notches lock the two parts. When it is mounted, the radial clearance between the peripheral zone of the base part and the peripheral zone of the tamperproof strip provides a slight rotation of the cap relative to the base part, until a notch of a strip is opposite an interval between two neighboring notches of the base part.

U.S. Pat. No. 5,456,374A, published on the 10 Oct. 1995 by Innovative Plastic Technology INC, discloses a tamper evident closure construction, which is provided for use with a container of the type having a neck with a discharge orifice therein. The tamper evident closure construction includes a dispenser cap and a unitary, one-piece, tamper evident closure cover. The dispenser cap includes a base connected to the neck and a dispensing portion connected to the base. The tamper evident closure cover consists of an overcap and a container closure cap separated by frangible webs which, when permanently disengaged, allow access to the dispensing portion and provide a visual indication of tampering. The container closure cap is fastened directly to the neck of the container and includes a breakaway tamperband, or alternatively, a snap-fit abutment arrangement, which provides an indication of attempts to remove the container closure cap from the neck. The skirt of the container closure cap is directly coupled to the neck of the container, and includes an annular bead on an inside surface and an annular flange which cooperate to secure and seal the base of the dispenser cap against the neck around the discharge orifice.

These examples disclose closures which avoid contamination of the mouth piece of the closure when the valve is closed with the help of an additional cover. The cover is attached to the closure in a removable manner. For initial opening a guarantee seal must be broken. Usually the cover can thereafter be reinstalled on the closure after consummation of liquid by the user. As the guarantee seal is broken and not foreseen to be established again, the cover is held on the closure by secondary holding means. It is crucial that the guarantee seal can be initially established quick and reliable when assembling the closure. Furthermore, for safety reasons it is crucial that the guarantee seal cannot be overcome without visibility from the outside.

It is an object of the present invention to improve the above mentioned disadvantages of the prior art closures and provide a closure that comprises an improved guarantee seal between a top cover and a base body which on the one hand can be easily and reliable produced by injection molding and assembled with a base body, but on the other hand is still highly secure and cannot be defeated under normal conditions. It is a further object of the invention to integrate a tamper band in way that if the top cover is removed, the tamper band offers only a minimal disturbance resp. discomfort for the user while drinking from the liquid container. Another further object of the invention to provide a closure with improved performance, such as venting, removal torque and so forth.

SUMMARY OF THE INVENTION

A closure for a liquid container, such as beverage containers or bottles, comprises according to the present invention a base body with a circumferential recess arranged concentric to a closure axis and in general extending in the direction of the closure axis. The closure axis is generally identically with an axis of symmetry of the essential circular closure and pointing in the direction of the opening of the liquid container and the closure. The base body is foreseen to receive a first tamper band at least partly in the circumferential recess interconnected by at least one tamper evident means to a top cover to cover an opening arranged at the base body. The integration of a lower end of the tamper band within the circumferential recess prohibits removing of the tampering band e.g. by means of using a leverage on the lower end of the tamper band and hence provides a tamper band integration that is highly secure. The opening may further be designed as a valve, which can regulate the flow rate from a liquid flowing out of the liquid container.

According to the invention, the circumferential recess comprises a first side surface and a thereto spaced apart second side surface, leaving a space in between. The first side surface comprises at least one circumferential protrusion extending in a radial direction into the recess. Preferably, the circumferential protrusion is vertically (in z-direction) spaced apart from a floor of the circumferential recess, which is located between the first and the second surface of the circumferential recess. The opposite second side surface comprises at least one pillar extending in the radial direction into the recess. The extension of the pillar may leave a remaining space to the thereto spaced apart, opposite first side or fully extend to it.

According to the invention, the first tamper band itself comprises a first side surface and a second side surface arranged opposite to the first side surface of the first tamper band. The first side surface of the first tamper band comprises at least one circumferential undercut foreseen to interact in a mounted position with the circumferential protrusion arranged at the first side surface of the circumferential recess. The circumferential undercut and the circumferential protrusion are shaped essentially similar. Important is however, that they interact e.g. snap together in a way that is hard to be reserved under normal circumstances. Preferably, the circumferential undercut is vertically spaced apart from a lower end of the first tamper band. Depending on the design the circumferential undercut and/or the circumferential protrusion may be segmented over the circumference. This may help during application.

The second side surface of the first tamper band comprises at least one notch extending in the direction of the closure axis. During insertion of the top cover and the first tamper band on the base body, the notch is foreseen to receive at least one pillar arranged at the second side surface of the circumferential recess from the direction of the closure axis to fix the cover, respective the first tamper band, in a mounted position in a rotational direction with respect to the base body. The notch further may be open in the radial outwards and/or radial inwards direction. In one possible variation, the notch may extend radially inwards and outwards from the first to the second surface of the base body so that the tamper band features a saw-tooth-like-shape.

The first side surfaces may be arranged with respect to the closure axis radially outside with respect to the second side surfaces or radially inside with respect to the second side surfaces, which implies that the surface on which the at least one pillar, respective the circumferential protrusion is located, can be swapped.

The circumferential undercut of the first tamper band may be arranged with respect to the circumferential protrusion of the circumferential recess such that during assembly in the direction of the closure axis (z-direction) a lower end of the first tamper band enters the circumferential recess before the circumferential protrusion interacts with the circumferential undercut. This is advantageous, since during insertion the interaction of the circumferential protrusion with the circumferential undercut may cause deformations of the first tamper band that may further disturb a neat and entry of the tamper band in the circumferential recess, cause unreasonable high insertion forces and may damage parts of the tamper band.

For similar reasons, it is further advantageous, that the at least one notch of the first tamper band is arranged with respect to the at least one pillar of the circumferential recess such that during assembly in the direction of the closure axis (z direction) the lower end of the first tamper band enters the circumferential recess before the at least one pillar interacts with the at least one notch.

For a good interconnection of the tamper band on the base body, the height of the at least one pillar measured from a floor of the circumferential recess is preferably less than the depth of the notch measured from the lower end of the first tamper band so that a butt joint is formed between the lower end of the first tamper band and the floor of the circumferential recess.

To prohibit an unwanted tilt during insertion of the tamper band, it is further advantageous, that the circumferential protrusion, the circumferential undercut, the at least one notch and the at least one pillar are arranged such that during assembly the circumferential protrusion interacts with the circumferential undercut after the at least one notch interacts with the at least one pillar.

The at least one notch comprises at least one inclined lead in surface to, during assembly, guide a thereto related pillar into the notch. Preferably, two lead in surfaces are present that form a funnel shaped lead in entry for each notch, with the two lead in surfaces inclined in opposite directions. If multiple notches are present which each feature only one lead in surface, the respective lead in surfaces are inclined advantageously all in the same direction along the circumference.

During the assembly of the top cover and the base body, it is advantageous that the at least one pillar first engages with the at least one lead in surface of the thereto related notch of the top cover before the circumferential undercut of the top cover interacts with the circumferential protrusion of the base body. Otherwise, the interaction of the undercut and the protrusion might result in a deformation that disturbs or even prohibits the entry of the at least one pillar into the thereto related notches.

In one variation of the invention, multiple notches may be arranged evenly distributed circumferentially on the first tamper band. However, other distributions may also be possible, such that the first tamper band may comprise at least one recessed section without notches.

In the case of a recessed section without notches, multiple (in at least two) notches are arranged on the second side surfaces of the first tamper band within at least one circular arc segment with a central angle $\beta$. Multiple pillars may further be present with a central angle $\alpha$ spanned between the two adjacent pillars spaced the farthest away from each other and which angle $\alpha$ is smaller than the angle $\beta$. A set-up of multiple notches and corresponding pillars according to the invention enables an interconnection of the pillar to the notches independent of the rotational position between the top cover and the base body.

To prohibit an accumulation of liquid within the circumferential recess, the radially outer side surface of the circumferential recess may further comprises a drainage hole through which excess liquid may be drained.

Alternatively or in addition to that, a circumferential bead, defined by the outer side surface of the circumferential recess and protruding in the axial direction above a top deck of the base body may be segmented.

The first tamper band is preferably connected to the top cover by tearable bridges and/or a tearable thin web of material forming a guarantee seal to see if the liquid container has been tampered with.

The base body may further comprise a thread on the inside for screwing the base body on a neck of the liquid container. A second tamper band may be used for a tamper evident connection of the base body to the container neck. Alternatively the closure can be snapped onto a bottle which avoids the need of a thread on the inside.

A sealing means may be arranged on the inside of the base body. Good results can be achieved if the seal is in axial direction arranged essentially below the circumferential recess to seal the interconnection of the base body to the neck of the liquid container. The sealing means preferably comprises a bore seal, however, other sealing means are possible. Good results can be achieved by a seal as described in WO2012095501, WO2006117024, or WO2006024550 of the same applicant.

Alternatively or in addition to that, the top cover may be interconnected to the first tamper band by a hinge. Depending on the field of application, the hinge can be a snap hinge providing a stable closed and a stable open position and a snapeffect in between. An example of such a hinge can be found e.g. in WO2009101117A1 or WO2005007526A1 of the same applicant. If the tamper band comprises a recessed section without any notch, as described above, the hinge is preferably located within this section.

The top cover and the base body are preferably produced by an injection molding process.

BRIEF DESCRIPTION OF THE DRAWINGS

The herein described invention will be more fully understood from the detailed description given herein below and the accompanying drawings, which should not be considered limiting to the invention described in the appended claims. The drawings are showing:

DESCRIPTION OF THE EMBODIMENTS

Figure 1:
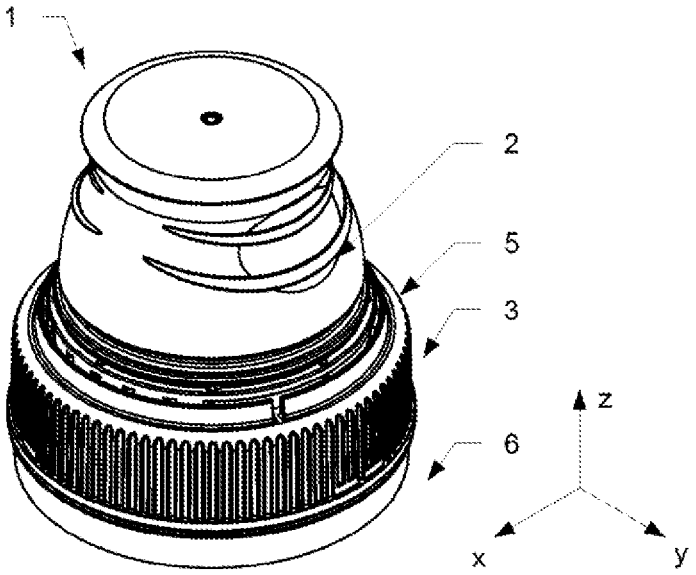
FIG. 1 A preferred variation of a closure according to the invention in a perspective view.
Figure 2:
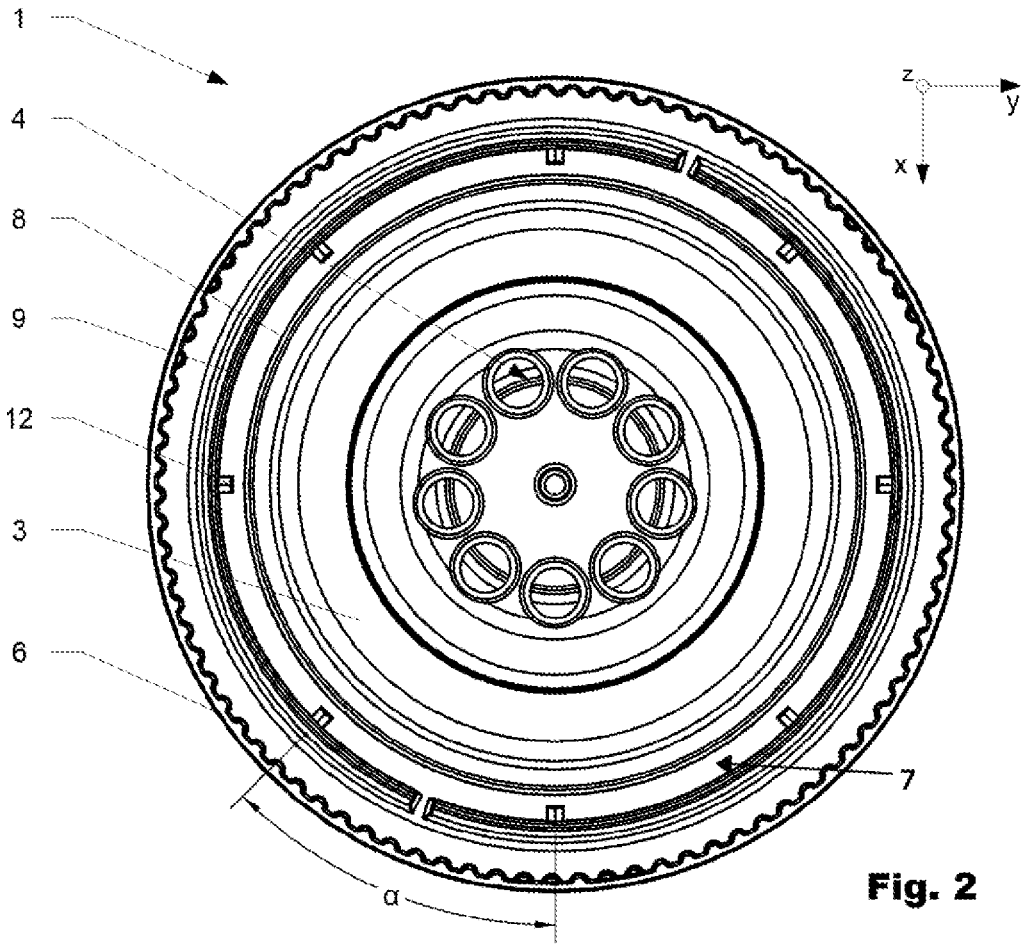
FIG. 2 the preferred variation of the closure according to the invention in a top view without a top cover.
Figure 3:
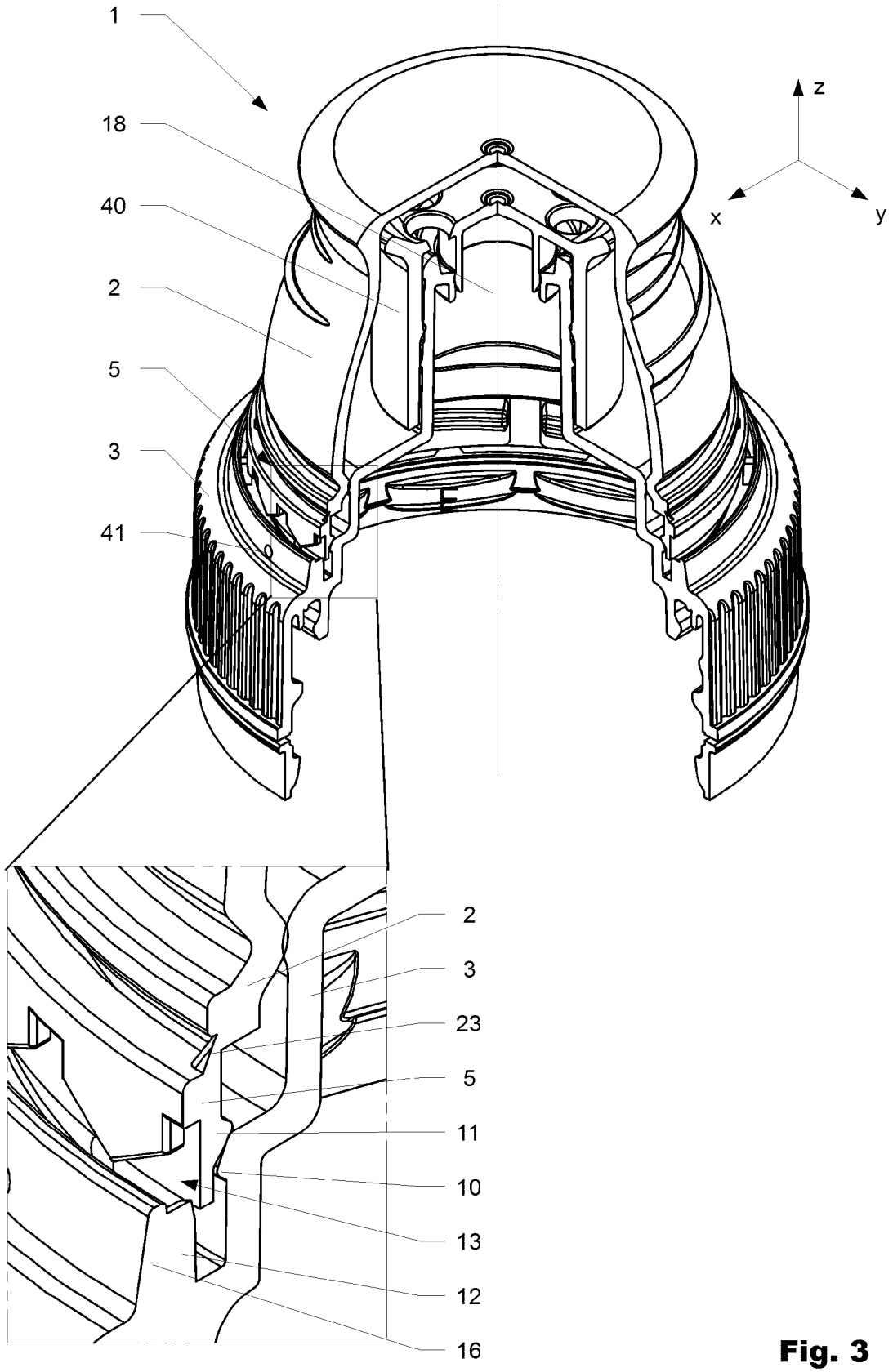
FIG. 3 a perspective, partly sectionized view of the closure according to FIG. 1.
Figure 4:
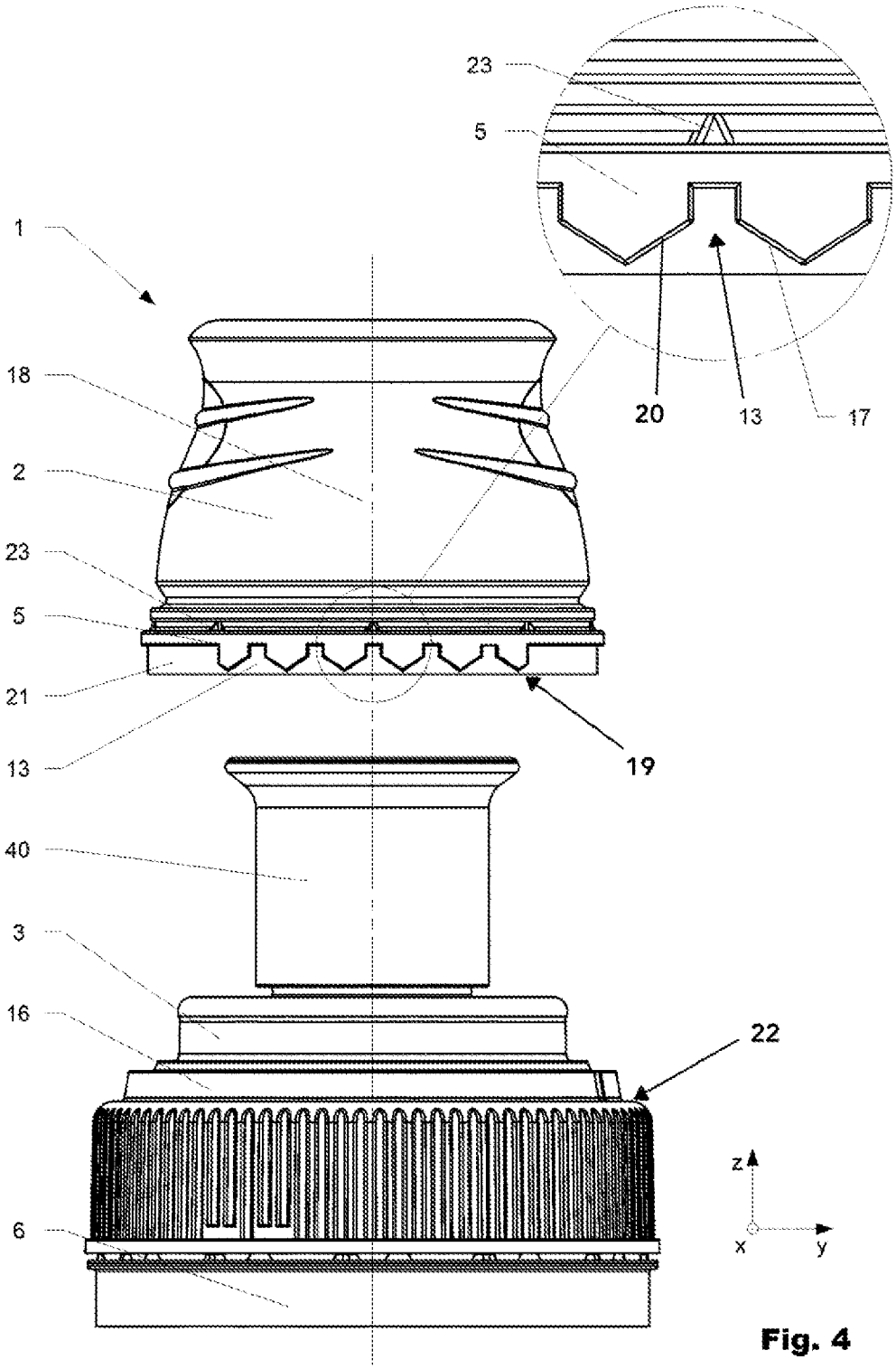
FIG. 4 the closure according to FIG. 1 in a side view partly disassembled.
Figure 5:
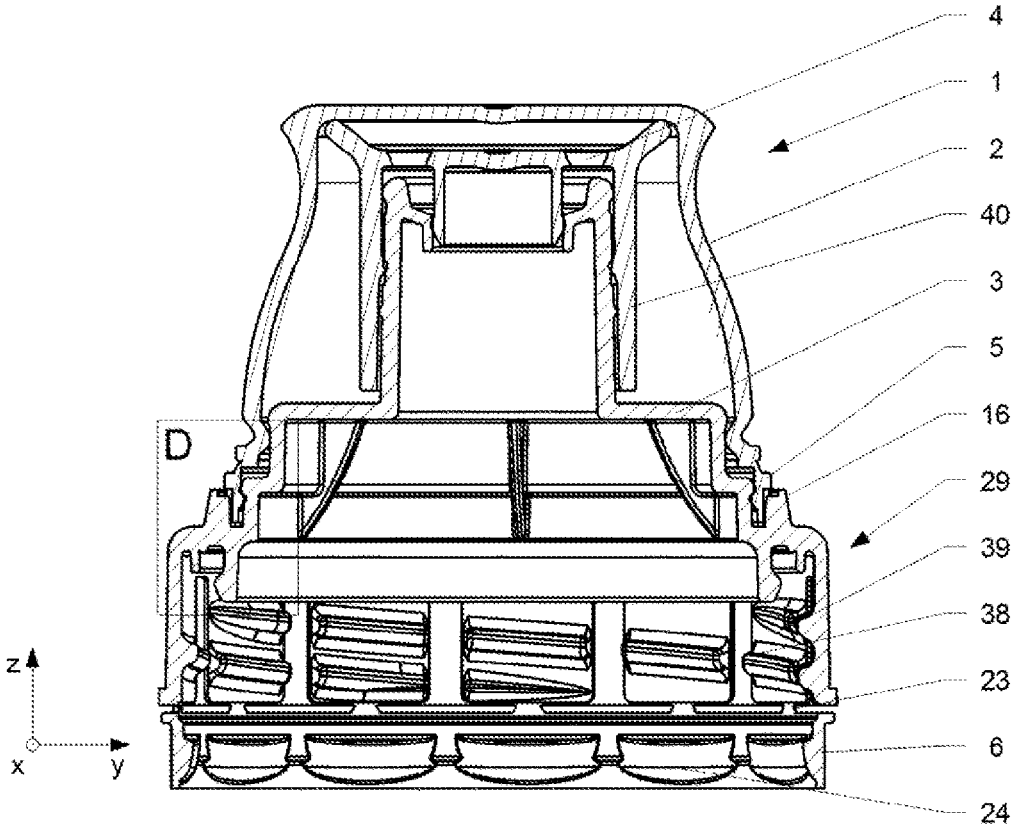
FIG. 5 a sectionized side view of the closure with top cover 2 according to FIG. 1.

FIG. 1 shows a first embodiment of a closure 1 according to the invention in a perspective view. FIG. 2 shows the same closure 1 in a top view without a top cover 2. FIG. 3 further illustrates the same variation of closure of FIG. 1 in a perspective, partly sectionized view and FIG. 4 illustrates the embodiment with the top cover partly disassembled. FIG. 5 shows a section view of the closure with top cover 2 according to FIG. 1 with certain details further outlined in FIG. 6.

As it can be seen in FIG. 1, the closure 1 according to the shown variation of the invention comprises an essential circular top cover 2 which is fixed on a base body 3 covering an opening 4. A first tamper band 5 is interconnected to the lower end of the top cover 2 for an attachment to the base body 3. Furthermore, a second temper band 6 is attached to the lower end of the base body 3 to attach the closure 1 to a bottle neck (not shown here).

The top view of FIG. 2 further depict the opening 4 which is designed as a valve 40. The valve 40 is not part of the invention and may be replaced by another geometry of the opening 4. In this case nine openings 4 are present on top of the valve 40. The valve 40 can be moved from a closed to an open position. In the open position the valve 40 is vertically displaced (in positive z-direction away from the base body) so that the valve 40 has a greater distance to the lower end of the base body 3. In that position, a passage of the liquid contained in the bottle (not shown here) attached to the base body 3 is created in order for a person to drink from said bottle through the continuous holes.

As it can be seen in FIG. 2 and the sectionized perspective view of FIG. 3, the base body 3 has a circumferential recess 7 that is formed by a circumferential bead 16 and that is having a first 8 and a second side surface 9. Within the circumferential recess 7 multiple pillars 12 are placed to fixate the first tamper band 5 of the top cover 2 on the base body 3 extending from the second side surface 9 in radial direction into the circumferential recess 7. In the shown variation the pillars 12 radially extend from the outer side surface 9, but leaving a remaining space to the thereto spaced apart first side 8. In this variation eight pillars 12 are evenly spaced over the circumference of the base body 3, however, other numbers or distributions are possible. Two neighboring pillars 12 have a central angle $\alpha$ of the essential circular base body 3. In the case of eight pillars 12, the angle $\alpha=45°$. Furthermore, a circumferential bead 16 may be present over the hole circumferential of the base body 3 or, as illustrated in this variation, the bead 16 may be interrupted and divided into multiple parts (here 2 parts shown; however any other number may be chosen).

Figure 7:
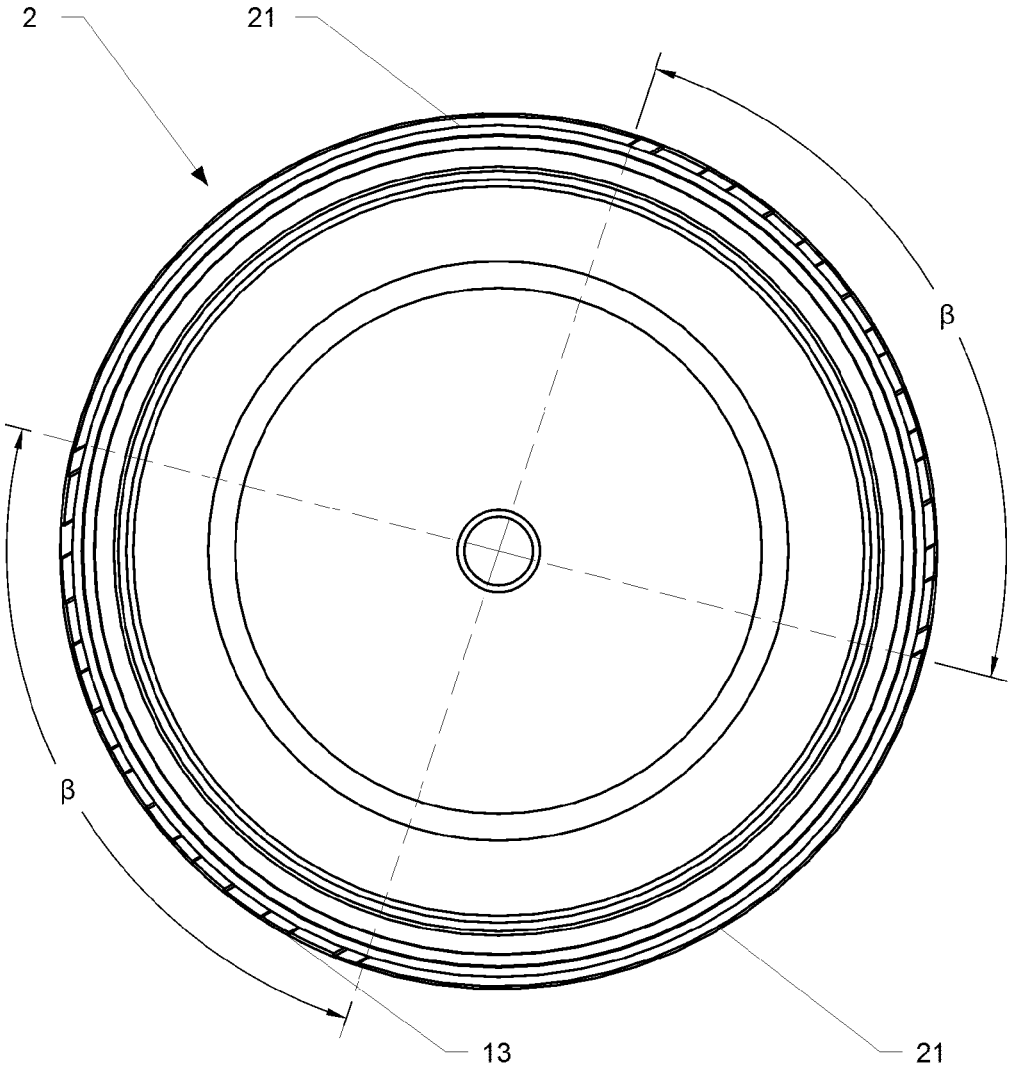
FIG. 7 the preferred variation of the top cover according to the invention in a bottom view.

The first tamper band 5 comprises a first side surface 14 and a second side surface 15 arranged opposite to the first side surface 14. In the preferred variation, the first tamper band 5 comprises two recessed sections 21 without notches. It can further be seen, that the first tamper band 5 has preferably a smaller diameter than the second tamper band 6. As it can be seen also be seen in FIG. 4 and FIG. 7, the first tamper band 5 comprises notches 13 on the outside of the essential circular first tamper band. In this variation of the invention, the notches 13 are only located partly over the circumference within two circular arc segments with a central angle $\beta$ of the essential circular top cover 2 whereby the angle $\beta$ is larger than the angle $\alpha$ between each pillar 12. Hence, two recessed sections 21 without any notches 13 are present. In the shown variation, the notches 13 comprise two inclined lead in surfaces 20 to, during assembly, guide a thereto related pillar 12 into the notch 13. The two inclined lead in surfaces 17 and 20 form a funnel shaped lead in entry for each notch 13, with the two lead in surfaces 17 and 20 inclined in opposite directions.

The set-up of notches 13 and corresponding pillars 12 according to the invention enables an interconnection of the pillar 12 to the notches 13 independent of the rotational displacement between the top cover 2 and the base body 3, if the two parts are concentrically orientated with respect to each other and providing a minimal adjustment rotation, for the pillar 12 to slit into within the notch 13 guided by the lead in surfaces 17 and 20 of the notches 13.

The first tamper band 5 is further interconnected to the top cover 2 by tearable bridges 23 which may be integrally formed when making of the top cover 2 of the closure 1. The tearable bridges 23 are preferably pyramidal shaped with a tip arranged in the positive z-direction. Depending on the field of application and the performance of the closure alternatively the tearable bridges can be made by a scoring process.

The second tamper band 6 also features tearable bridges 23 which may integrally be formed when making of the base body 3 of the closure 1. The second tamper band 6 comprises on the inside radial inwardly directed protrusions 24 which are foreseen to latch with a corresponding bead (not shown in detail) on the neck finish.

Figure 6:
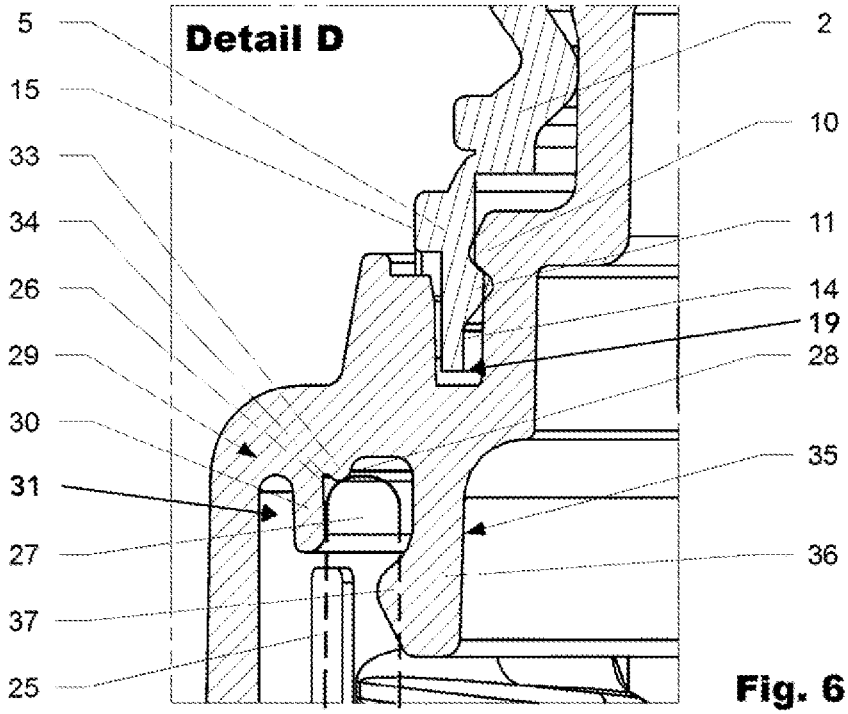
FIG. 6 detail D according to FIG. 5.

FIG. 5 depict the same embodiment of the closure with the top cover 2 attached in a sectionized view and FIG. 6 depict details of the sealing and the first tamper band 5.

It can be seen, that the first tamper band 5 comprises a first side surface 14 and a second side surface 15 arranged opposite to the first side surface 14, wherein the first side surface 14 of the first tamper band 5 comprises at least one circumferential undercut 11 foreseen to interact in a mounted position with the circumferential protrusion 10 arranged at the first side surface 8 of the circumferential recess 7. The notches 13 orientated on the second side surface 9 of the first tamper band 5 extend in the direction of the closure axis 18 (z direction) and are foreseen to receive at least one pillar 12 arranged at the second side surface 9 of the circumferential recess 7.

During insertion of the first tamper band 5 in the circumferential recess 7 of the base body 3 the order of how the various parts interact with each other is important for a smooth assembly. First, the lower end 19 of the first tamper band 5 enters the circumferential recess 7 in the direction of the closure axis before the at least one pillar 12 interacts with the at least one notch 13. Furthermore, the circumferential protrusion 10 and the circumferential undercut 11 and the notches 13 and the pillars 12 are arranged such that during assembly the circumferential protrusion 10 interacts with the circumferential undercut 11 after the lead in surfaces 17 and 20 of the notches 11 interact with the pillars 12.

This variation of the invention comprises further on the inside a sealing means 29 which interacts at least with an outer surface 25 and a rim surface 26 of the neck finish 27, when the closure 1 is applied to a neck finish 27 (cross-section in FIG. 6 schematically indicated by dashed line). The rim surface 26 interconnects the outer surface 25 with an annular end surface 28. The sealing means 29 is shown in a non-deformed manner. As it can be seen the sealing means 29 comprises in the shown embodiment an outer leg 30 with an in general constant thickness. The outer leg 30 is separated by a gap 31 from the base body 3. The gap 31 allows that the outer leg 30 to be deformed freely in a radial direction.

At the inner rear end of the outer leg 30, a bump 33 is visible which is designed and arranged such that when the closure is applied onto the neck finish 27 the bump 33 interacts with the rim surface 26 forming a second sealing area. The bump 33 is functionally separated from the outer leg 30 by a dent 34. The functional interaction between the outer leg 30 and the bump 33 can be adjusted by the shape of the dent 34. The dent 34 avoids unwanted interaction between the outer leg 30 and the bump 33 when deformation of the shell of the closure 1 occurs.

As it can be seen in FIG. 6, the sealing means 29 further comprises a bore seal 35 having a cross-section consisting of an inner leg 36, which reaches into the neck finish 27 when the closure is applied on the neck finish 27 and acts as a bore seal 35. The inner leg 36 has a protrusion 37 extending radial outwardly and forming in applied position a third sealing area between the sealing means 29 and the neck finish 27. The bore seal 35 may have different shapes depending on the field of application.

It can further be seen that the base body 3 comprises on the inside a thread 39, which consists out of thread segments. Between two in circumferential (helical) direction adjacent thread segments, channel-like recesses 38 are arranged on the inside of the base body 3 in a preferably vertical direction (parallel to a closure axis z; vertical means in general vertical). The shown embodiment comprises in total twelve channel-like recesses 38, which are circumferentially evenly distributed between the thread segments 39. As it can be seen, the recesses 38 extend in axial direction at least across the two in axial direction adjacent thread segments 39. By the evenly distributed and balanced arrangement of the thread segments 39 and the channel-like recesses 38, a balanced distribution of the load is achieved, which e.g. may occur due to internal pressure or the like.

| LIST OF DESIGNATIONS | |
|---|---|
| 1 | Closure |
| 2 | Top cover |
| 3 | Base body |
| 4 | Opening |
| 5 | First tamper band |
| 6 | Second tamper band |
| 7 | Circumferential recess |
| 8 | First side surface (base body) |
| 9 | Second side surface (base body) |
| 10 | Circumferential protrusion |
| 11 | Circumferential undercut |
| 12 | Pillar |
| 13 | Notch |
| 14 | First side surface (first tamper band) |
| 15 | Second side surface (first tamper band) |
| 16 | Circumferential bead |
| 17 | Lead in surface |
| 18 | Closure axis |
| 19 | Lower end |
| 20 | Lead in surface |
| 21 | Recessed section |
| 22 | Top deck |
| 23 | Tearable bridges |
| 24 | Protrusions (second tamper band) |
| 25 | Outer surface |
| 26 | Rim surface |
| 27 | Neck finish |
| 28 | Annular end surface |
| 29 | Sealing means |
| 30 | Outer leg |
| 31 | Gap |
| 33 | Bump |
| 34 | Dent |
| 35 | Bore seal |
| 36 | Inner leg |
| 37 | Protrusion (inner leg) |
| 38 | Channel-like recesses |
| 39 | Thread |
| 40 | Valve |
| 41 | Drainage hole |

What is claimed is:

1. A closure for a liquid container comprising a) a base body with a circumferential recess arranged concentric to a closure axis (z) extending in the direction of the closure axis (z) and foreseen to receive a first tamper band interconnected by at least one tamper evident means to a top cover to cover an opening arranged at the base body, wherein b) the circumferential recess comprises a first side surface and a thereto spaced apart second side surface, wherein the first side surface comprises at least one circumferential protrusion extending in a radial direction into the recess and the opposite second side surface comprises at least one pillar extending in the radial direction in the recess wherein c) the first tamper band comprises a first side surface and a second side surface arranged opposite to the first side surface, wherein the first side surface of the first tamper band comprises at least one circumferential undercut foreseen to interact in a mounted position with the circumferential protrusion arranged at the first side surface of the circumferential recess, and the second side surface of the first tamper band comprises at least one notch extending in the direction of the closure axis and foreseen to receive at least one pillar arranged at the second side surface of the circumferential recess, wherein the first side surfaces are arranged with respect to the closure axis radially inside with respect to the second side surfaces, and wherein the at least one notch of the first tamper band is arranged with respect to the at least one pillar of the circumferential recess such that during assembly in the direction of the closure axis a lower end of the first tamper band enters the circumferential recess before the at least one pillar interacts with the at least one notch.

2. The closure according to claim 1, wherein the circumferential undercut of the first tamper band is arranged with respect to the circumferential protrusion of the circumferential recess such that during assembly in the direction of the closure axis a lower end of the first tamper band enters the circumferential recess before the circumferential protrusion interacts with the circumferential undercut.

3. The closure according to claim 1, wherein the circumferential protrusion and the circumferential undercut and the at least one notch and the at least one pillar are arranged such that during assembly the circumferential protrusion interacts with the circumferential undercut after the at least one notch interacts with the at least one pillar.

4. The closure according to claim 1, wherein the at least one notch comprises at least one lead in surface to, during assembly, guide a thereto related pillar into the notch.

5. The closure according to claim 4, wherein during the assembly of the top cover and the base body, the at least one pillar first engages with the at least one lead in surface of the at least one notch of tamper band before the circumferential undercut of the top cover interacts with the circumferential protrusion of the base body.

6. The closure according to claim 1, wherein at least two notches are present, which are arranged evenly distributed circumferentially on the first tamper band.

7. The closure according to claim 1, wherein the first tamper band comprises at least one recessed section without any notch.

8. The closure according to claim 1, wherein the side surface of the circumferential recess arranged radially outside comprises a drainage hole through which excess liquid may be drained.

9. The closure according to claim 1, wherein the side surface of the circumferential recess arranged radially outside is defined by a circumferential bead protruding in the axial direction above a top deck of the base body.

10. The closure according to claim 9, wherein the circumferential bead is segmented.

11. The closure according to claim 1, wherein in axial direction below the circumferential recess a bore seal is arranged on the inside of the base body.

12. The closure according to claim 1, wherein a sealing means is arranged on the inside of the closure essentially below the circumferential recess.

13. The closure according to claim 1, wherein the first tamper band is connected to the top cover by tearable bridges and/or a tearable thin web of material forming a guarantee seal.

14. The closure according to claim 1, wherein the top cover is interconnected to the first tamper band by a hinge.

15. The closure according to claim 14, wherein the hinge is a snap hinge providing a closed and an open position.

* * * * *